United States Patent [19]

Manini et al.

[11] 4,316,488

[45] Feb. 23, 1982

[54] HIGH SPEED CIRCULAR LOOM FOR THE PRODUCTION OF TUBULAR FABRICS STARTING FROM THREADS, STRAPS AND THE LIKE MADE OF SYNTHETIC AND NATURAL SUBSTANCES

[75] Inventors: Benito Manini, Florence; Edoardo Furia, La Romola; Eugenio Stefani; Giuliano Baldi, both of Florence; Pasquale Barracchia, Milan; Beniamino Cacciapuoti, Aulla; Bruno Mattei, La Spezia, all of Italy

[73] Assignee: Moplefan S.p.A., Milan, Italy

[21] Appl. No.: 137,912

[22] Filed: Apr. 7, 1980

[30] Foreign Application Priority Data

Apr. 11, 1979 [IT] Italy ..... 21772 A/79

[51] Int. Cl.[3] ..... D03D 37/00

[52] U.S. Cl. ..... 139/13 R

[58] Field of Search ..... 139/13 R, 16, 436

[56] References Cited

U.S. PATENT DOCUMENTS

| | | | |
|---|---|---|---|
| 1,589,189 | 6/1926 | Lommis | 139/13 R |
| 2,715,915 | 8/1955 | Carty et al. | 139/13 R |
| 2,808,071 | 10/1957 | Carty et al. | 139/13 R |
| 2,811,986 | 11/1957 | Jacob et al. | 139/13 R |
| 4,031,927 | 6/1977 | Komarov et al. | 139/436 |

FOREIGN PATENT DOCUMENTS

| | | | |
|---|---|---|---|
| 641544 | 4/1928 | France | 139/13 |

*Primary Examiner*—Henry Jaudon

*Attorney, Agent, or Firm*—Stevens, Davis, Miller & Mosher

[57] ABSTRACT

A circular loom is disclosed for tubular fabric consisting essentially of strips of synthetic, artificial and natural substances, said loom being of the vertical heald type with healds arranged on concentric rings, with the drawing and the winding up of the fabric being formed on a fabric gauging cylinder arranged downstream of the shuttles, characterized in that said loom comprises one single rotary positive cam with a double track for the control of the alternate motion of the healds, said cam consisting essentially of a hollow cylinder turning coaxially inside the fabric-gauging cylinder and on whose outside cylindrical surface there are provided two closed track guide cams having a substantially helicoidal development, of which one is the cam controlling the motion of the external healds, while the other controls the internal healds, those guiding cams being associated with guide-pads or cam followers which are integral with saddles carrying the healds mounted slidably in fixed vertical guides, thereby imparting to the two series of healds their alternate up-and-down motion, said healds being, moreover, axially constrained by elastic or resilient means to the corresponding supporting saddles so that they may be all blocked automatically in their lower position by the hooking in of their lower ends on corresponding oscillating hooks mounted displaceably in a coaxial alignment with the healds themselves, so as to retain all the warp strips on a level below the plane of sliding of the shuttles.

5 Claims, 9 Drawing Figures

HIGH SPEED CIRCULAR LOOM FOR THE PRODUCTION OF TUBULAR FABRICS STARTING FROM THREADS, STRAPS AND THE LIKE MADE OF SYNTHETIC AND NATURAL SUBSTANCES

The present invention relates to a high-speed circular loom for the continuous weaving of strips and the like of any type and substance, but preferably of plastic materials, improved so as to enable the attainment of high rotational speeds and, thus, a high output, and particularly with a significantly reduced noise index.

As is well known, the traditional circular looms for the weaving of tubular fabrics in general, and of tubular fabrics made from strips of plastic material, comprise two series of healds arranged on two concentric rings and subjected to an alternating up-and-down motion required for ensuring the alternate straddling of the strips of the warp. The warp strips are guided through a cylindrical reed and are then diverted into a hollow vertical cylindrical body (a fabric sizer) on whose upper circular edge or rim there takes place the formation of the tubular fabric by the introduction of the weft strips between the warp strips. The weft strips are fed by one or more shuttles, which carry in them the strip bobbins and are put into rotary motion on the circular reed and are guided on this reed by means of suitable guiding pads (sliding blocks). The shuttle, rotating between the alternately opened warp strips, feed their own weft strip between the warp strips according to a spiral trajectory which closes on the edge of the vertical cylindrical body, commonly also called "buse". The tubular fabric is thus formed continuously on the circular edge or rim of the buse from which it is constantly drawn off through the buse itself and then wound up on a reel or bobbin.

In this type of circular loom, the kinematic motions adopted in general for the alternating motion of the healds consist of a camshaft revolving in synchronism with the circular loom, the cams thereof acting on a travel-amplifying lever, and by means of tie rods and transmissions connected to counteracting springs, compelling the corresponding heald to accomplish the necessary travel.

These kinematic motions, controlling the movement of the healds, in practice show a number of different drawbacks that may be briefly summarized as follows:

the reduced dimensions of the cams, due to the requirements of reduced overall dimensions combined with the necessity of amplifying the travels, allow only an approximate control of the end travel of each heald, that is, of the reversing points, upper and lower point, of the travel of the healds;

the unavoidable clearances of the linkages used cause a considerable noisiness and increase the danger of breakages and/or failures due to the great number of components;

the counteracting springs, through the effect of the harmonic frequencies which conform with difficulty with the travels required by the healds, limit the speed of the whole loom; and finally, the weight and inertia of all the machine elements subjected to an alternate motion and to friction at the articulated joints, all combine to limit the operational speed of the loom.

Moreover, the greatest part of the circular looms of the known type show the drawback that the shuttle with the weft-strip-carrying bobbin remains always shut in between the warp strips, both with the loom in operation as well as when the same is at rest, wherefore both the substitution or replacement of the empty bobbins as well as the reknotting of a ruptured weft strip becomes a very difficult operation. Lastly, in the known types of looms, no particular stopping devices are provided for the stopping of the loom in order to avoid, in case of a rupture of a weft strip, the formation of voids in the weft of the fabric.

Thus an object of this invention is that of providing a circular loom for the production of tubular fabrics from strips in general, and from strips of thermoplastic polymers and the like more particularly, improved in such a way as to obviate the drawbacks and limitations shown by the looms of the known type; and above all, that it be such as to allow a smooth running at much higher rotational speeds than is obtainable on the known looms, with the advantage of a reduced noisiness kept within acceptable limits.

Another object of this invention is that of providing a circular loom of the specified type employing kinematic motions for the control and stoppage of the healds suited to exactly control the end travel of the healds, thereby bringing about an appreciable reduction of the ruptures of warp and weft strips and an excellent reliability of the whole equipment due to the limited number of mobile components in operation and the total absence of counteracting springs and the like.

A still further object of this invention is that of providing an improved circular loom which will exclude, or at least limit as much as possible, the possibility of the formation of weft voids caused by the rupture of weft strips themselves, as well as to allow also an easy reknotting of weft strips in case of their rupture, and a fast and equally easy replacement of the empty bobbins.

These and still other objects, which will become even more clearly apparent from the detailed description that follows, are achieved by means of a circular loom for tubular fabrics obtained with strips, preferably but not exclusively of plastic material, of the type having vertical healds arranged on two concentric circles or rings and with the drawing off and winding of the fabric located downstream of the shuttles, which loom according to the invention comprises one single rotary cam of the positive type with a double track for the alternate control of the healds, said cam consisting of a hollow cylinder arranged coaxially with the fabric-guiding cylinder and revolving in synchronism with the loom itself, while on the outside cylindrical surface there are provided two continuous and closed guiding tracks having a substantially cycloidal course, of which tracks, one forms the driving cam for the external healds and the other being the cam for controlling the internal healds, said guiding cams being combined with guiding pads or the like integral with the heald-carrying saddles which are mounted sliding inside fixed vertical guides, so as to impart to the two series of healds, at each full turn of said cam cylinder, the alternative up-and-down motions, said vertical healds being, moreover, axially restrained in an elastic or resilient manner by the corresponding supporting saddles, so that they may be automatically blocked in the lower position by engagement or hooking of their lower ends into oscillating hooks which are displaceable in the same vertical direction with the healds themselves so as to keep all the warp strips, inserted in the slots of the healds, at a level below the slide plane of the shuttles, thus leaving the shuttles themselves free and in sight to allow the reknotting of the weft strips in case of rupture, and allowing the replacement of the empty bobbins.

More particularly, said system for the hooking up and stopping the healds in the lower position, according to this invention, consists or consists essentially of a series of hooks hinged on a fixed ring, each hook being in correspondence with the axis of a heald, and all maintained deflected or inclined (slanting), with respect to the healds, by a pulling spring, all pulling springs of the hooks being hinged on a rotary platform that will displace the fulcra of said springs in such a way as to put the healds onto the axis of the corresponding healds and, thus, allow the hooking and stopping of the same in the lower position during their descending travel, the control of said rotary platform for the displacing of the hooks into a coaxial position with the axis of the healds being effected either automatically or manually, both in the case of the breakage of a weft strip as well as in the case of the replacement of empty bobbins.

In the loom, according to the invention, there is provided, moreover, a differential stopping device for the control of the healds and for the delayed winding up of the fabric, suited for limiting the formation of weft voids, said device consisting of an electromagnetic clutch or the like coupled to the main motor of the loom and operating the fabric-drafting device, said clutch being suited for stopping, on an electrical signal imparted by the shuttles, the fabric-drafting device, in case of rupture of the weft strip and for subsequently restarting the loom so as to obtain a thickening of the weft able to fill up the voids previously formed.

The constructional and functional characteristics of the improved loom, according to the present invention, will be described in further detail in what follows, which is according to a preferred practical embodiment, and with reference to the attached drawings, which are given for purely illustrative and not limiting purposes, and wherein.

Figure 7:
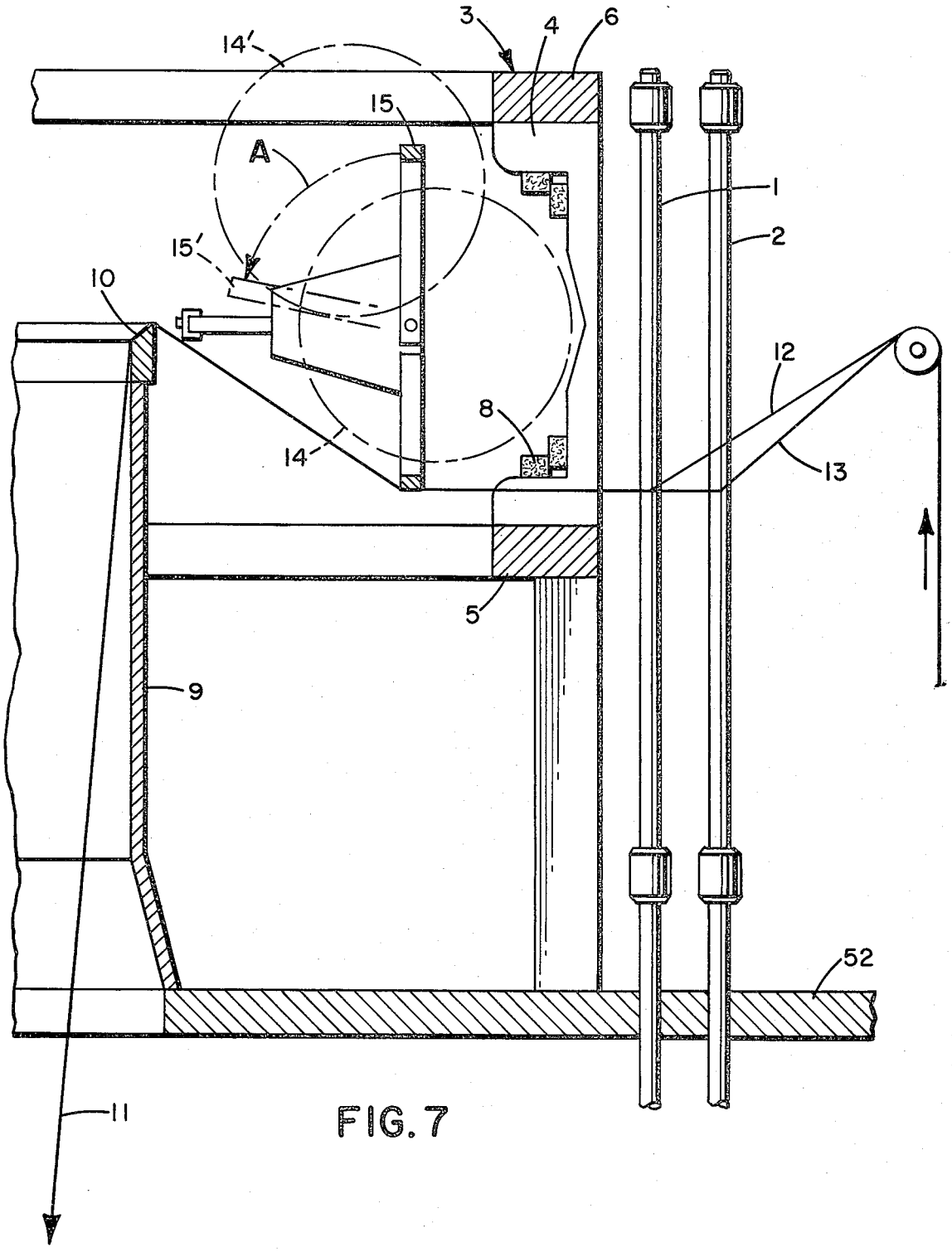
Figure 8:
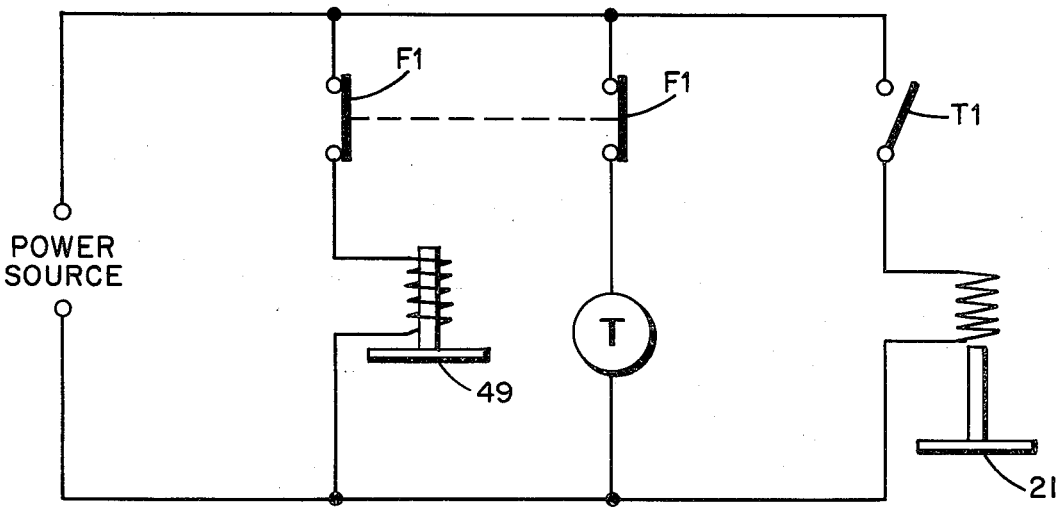
Figure 9:
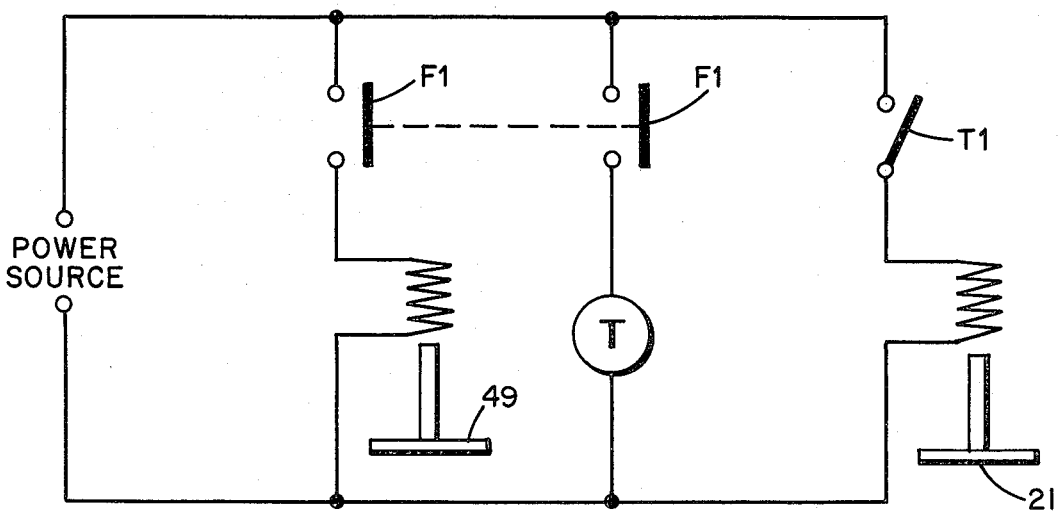

FIG. 7 shows, still schematically, the main constituent elements of a circular loom with the warp strips gathered below the sliding plane of the shuttles after blocking in the lower position the corresponding healds; while FIGS. 8 and 9 show, schematically, circuitry for actuating a stopping and delayed starting device for the loom, in the case of rupture of a weft strip represented respectively in the position of stopped loom and in the position of working loom.

Figure 1:
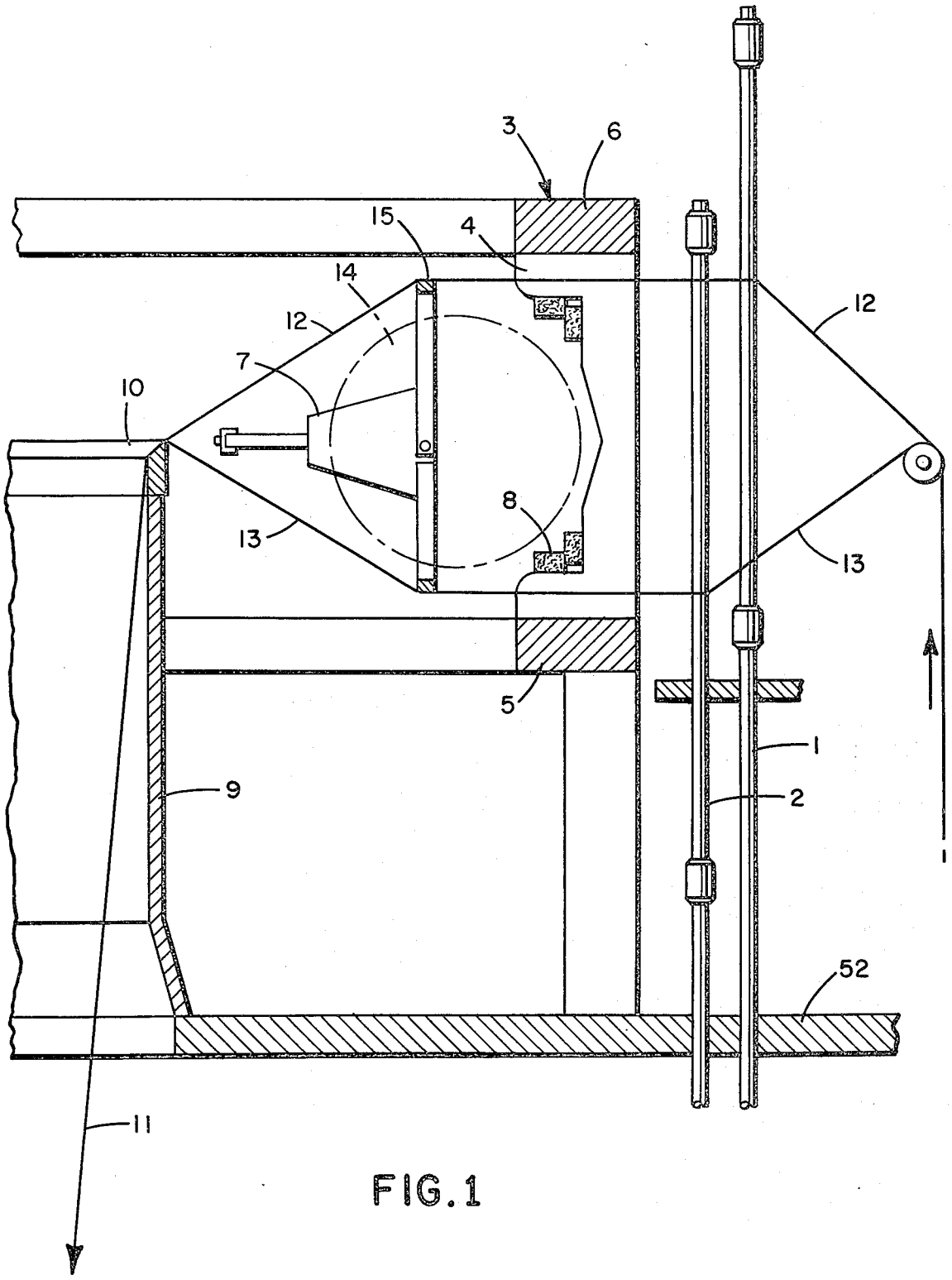
FIG. 1 shows schematically, partly as a side view and partly as a cross-sectional view, the main constituent elements of a circular loom for tubular fabrics, with warp strips shown in a diverged position.
Figure 2:
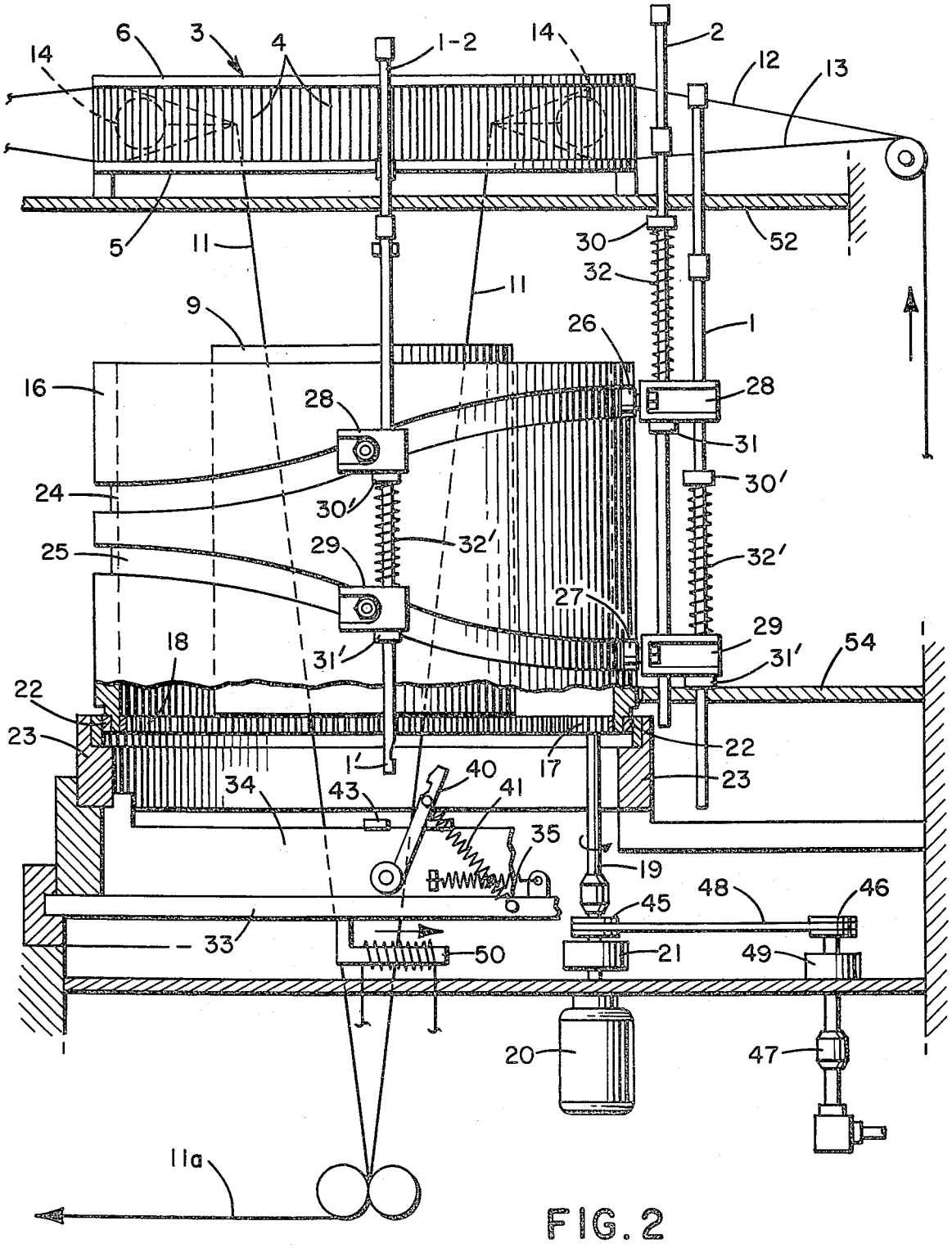
FIG. 2 shows, partly as a lateral view and partly as a sectional view, the high speed circular loom, according to the invention, including the positive cam device for the control of the healds.

Referring to the above figures, and particularly FIGS. 1 and 2, a circular loom for the weaving of tubular fabrics, according to the present invention, consists of two series of healds 1 and 2, arranged vertically movable and disposed in two concentric circumferences into a cylindrical supporting structure and subjected to an alternate motion; a cylindrical fixed reed 3 consisting of blades or reeds 4, arranged radially at equidistant intervals and blocked between opposite supporting rings 5 and 6; shuttles 7 rotating on the reed itself and guided by opposite guiding pads 8 and by a fabric-gauging (sizing) cylinder 9, placed centrally to the rings formed by the healds 1 and 2, on whose peripheral upper edge 10 the fabric 11 is formed.

The healds 1 and 2 carry the warp strips 12-13 coming from the continuous strip feeder (not shown), alternatively diverging them from each other on the vertical plane.

The warp strips 12-13 pass between blades 4 of the reed and join again on the circular edge 10 of the fabric-gauging cylinder 9.

One or more bobbins 14 of weft strip (not shown) force their way through the warp strips 12-13 by means of ring 15 which is integral with the shuttle 7.

The upward and downward motions of the warp strips are so programmed as to occur, with the bobbins revolving, between the free spaces between the bobbins, while the weft strip that unwinds from the rotating bobbins, is inserted helicoidally between the warp strips just on the edge 10 of the fabric-gauging cylinder 9.

The fabric 11 which is thus formed is stretched and drawn through fabric gauging cylinder 9 onto a bobbin by means of a conventional drawing and winding-up device, not represented in the drawings.

Figure 3:
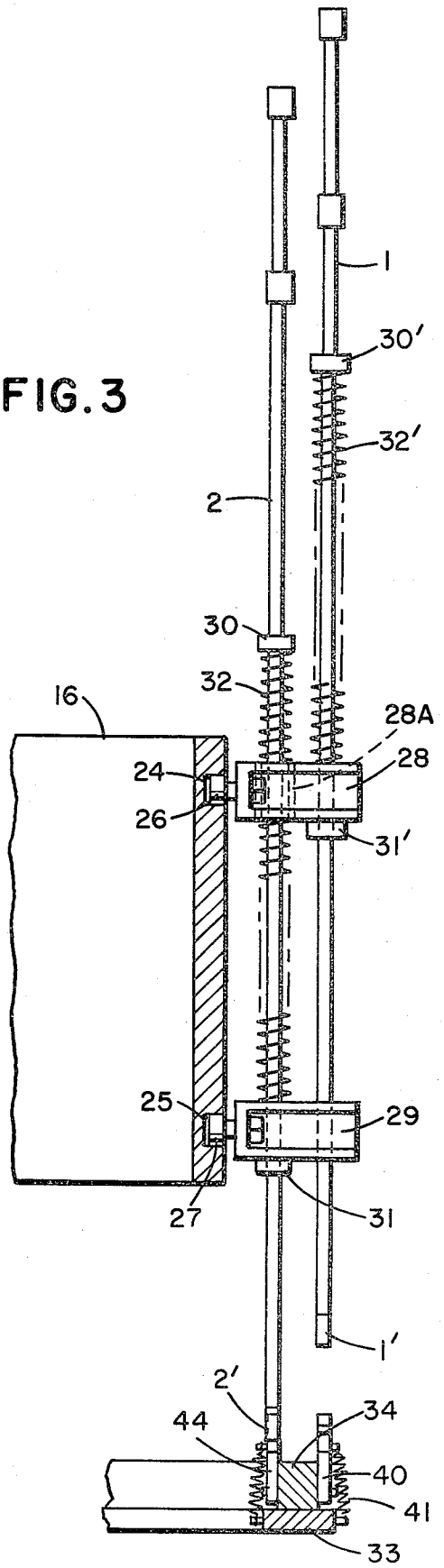
FIG. 3 shows schematically two healds and the corresponding kinematic devices, of which only the internal heald is blocked in the lower position.
Figure 4:
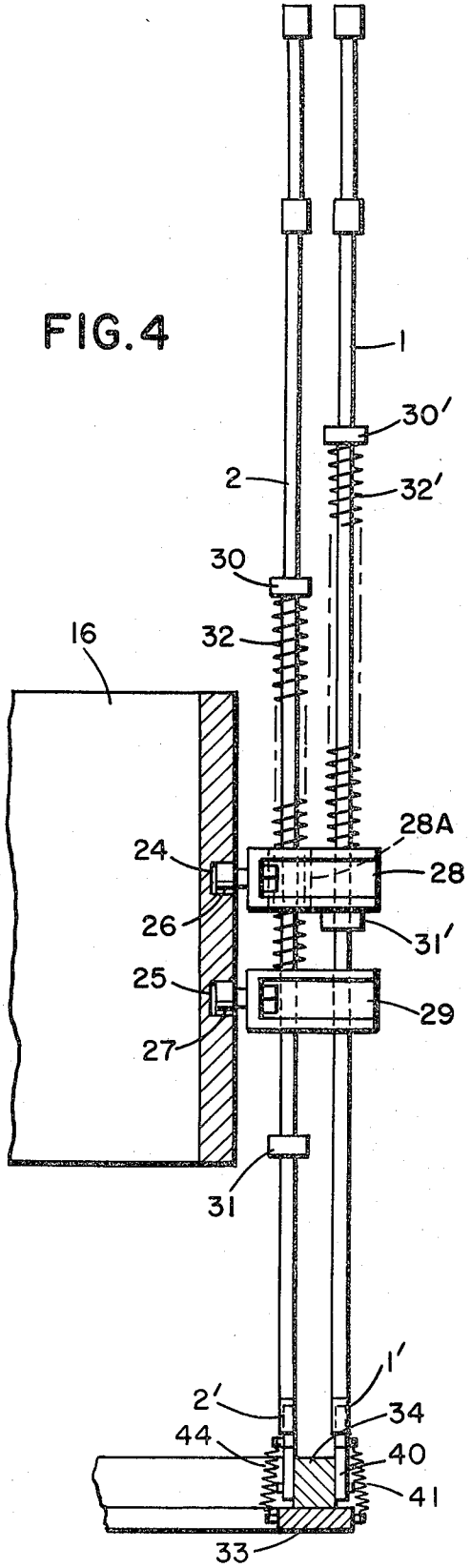
FIG. 4 shows the same embodiment as in FIG. 3, with both healds, the internal as well as the external one, blocked in the lower position.
Figure 5:
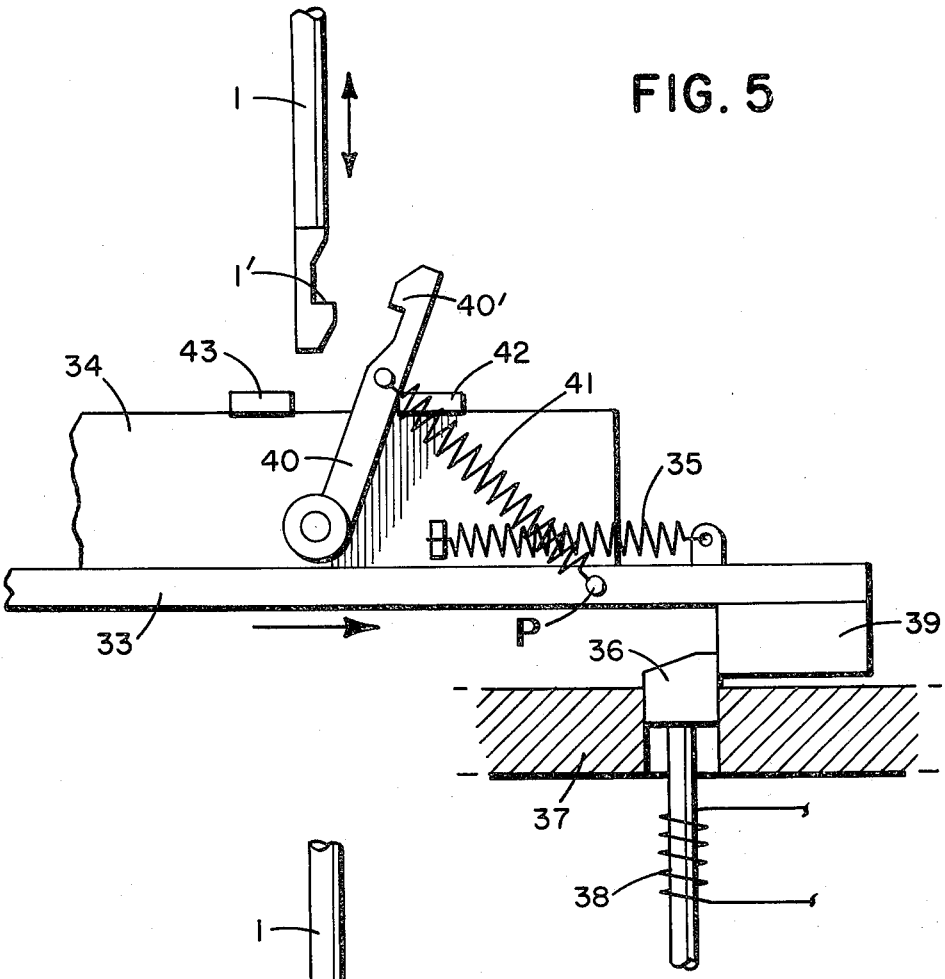
FIGS. 5 and 6 show, on an enlarged scale, a hook device for the blocking of the healds in the lower position, in which device the hook itself is respectively in the disengaged position and in a stable engaging position engaging the heald.

According to this invention, a kinematic motion suitable for controlling the healds of a loom represented in FIG. 1, as previously described, is represented in FIGS. 2 to 4.

With particular reference to FIG. 2, said kinematic motion control for the external healds 1 and for the internal healds 2 consists of a cylindrical cam 16 provided with a double track, and mounted externally and coaxially with respect to the fabric-gauging cylinder 9 revolving in synchronism with the loom.

The motion is transmitted by a pinion 17 meshing with toothed crownwheel 18, internally of the cam and driven by a shaft 19 which is driven by a motor 20 (FIG. 2) with the interposition of a conventional electromagnetic clutch 21. The cylindrical cam 16 is guided between bushings 22 anchored to the supporting base 23.

On the external surface of cam 16 are two grooves 24 and 25 which have a substantially helicoidal development and which form the closed track cams proper which compel the healds to carry out their alternate up-and-down movements or travel. For this purpose the grooves 24 and 25 engage the guiding pads 26 and 27, respectively, to which are integrally fixed saddles 28 and 29, respectively.

Each saddle is formed by a plate in which two holes are provided radially positioned with respect to the cam 16 for the sliding of the healds. Each saddle forms a guiding means for an internal and an external heald and, during the working of the loom, both the upper saddles 28 and the lower saddles 29 remain always superimposed in a vertical line, as shown in FIG. 2.

Each internal heald 2 (or group of healds) is connected to saddle 28 by means of two tieclamps 30 and 31 which are fixed on the heald with the interposition of a spring 32 suitably preloaded and inserted between the upper clamp 30 and the upper part of saddle 28. Heald 2 is, thus, free to slide vertically inside the saddle when spring 32 is further compressed, pushing heald 2 downwards, or saddle 28 upwards when the heald is blocked. In this latter case the lower clamp 31 remains detached from or, better still, drawn back from the saddle 28.

During the working of the loom, the heald 2 follows the travel of the upper saddle 28 and maintains its lower end freely slidable into a hole in the lower saddle 29.

Analogously, the outer healds 1 are anchored to saddle 29 by means of tie clamps 30' and 31' and the corresponding spring 32'. (See also FIGS. 3 and 4.)

In FIGS. 3 and 4, on the contrary, saddles 28 and 29 are connected with healds 1 and healds 2, that is, they are connected in the opposite way from that illustrated in FIG. 2.

The main function of the preloaded springs 32 and 32' is that of creating a sufficiently rigid constraint only vertically between saddle and heald stem, leaving the stem free to move, with a limited clearance, on the horizontal plane so as to be released from the necessity of a very precise alignment.

Springs 32 and 32' allow, moreover, the healds to be pushed downwards manually, independently from the position taken by the guiding roller pads 26 and 27 sliding in tracks 24 and 25.

With this positive closed-track cam system, obtained from one single rotating cylindrical body of relatively great diameter and dynamically balanced, phase displacements amongst the healds are avoided in practice and smooth and controlled accelerations and absence of noise are insured. Moreover, no limitations whatsoever influence the frequency of alternating motions (number of strokes) of the healds themselves in view of the total absence of counteracting springs continuously under tension, and in view of the low inertia of the moving elements.

Still further according to this invention, in order to facilitate both the reknotting of the weft strips in case of rupture, as well as the substitution or replacement of the empty bobbins, a device is provided for the blocking of the healds in the lower position and, practically, under the shuttles sliding on the reed.

FIG. 7 represents the position taken by the warp strips 12-13 with respect to the shuttle 7 when the healds 1 and 2 are blocked in their lower position. In this lower position the warp strips 12-13 in fact pass between the blades 4 of reed 3 at a level lower than that of the guiding pads 8 of the shuttle and thus bobbin 14 remains free and in sight and may be extracted easily by passing it from position 14 to the dashed position 14', after a rotation of about 90° C. of the guiding ring 15, according to the arrow A of FIG. 7, and its stopping in position 15'.

Figure 6:
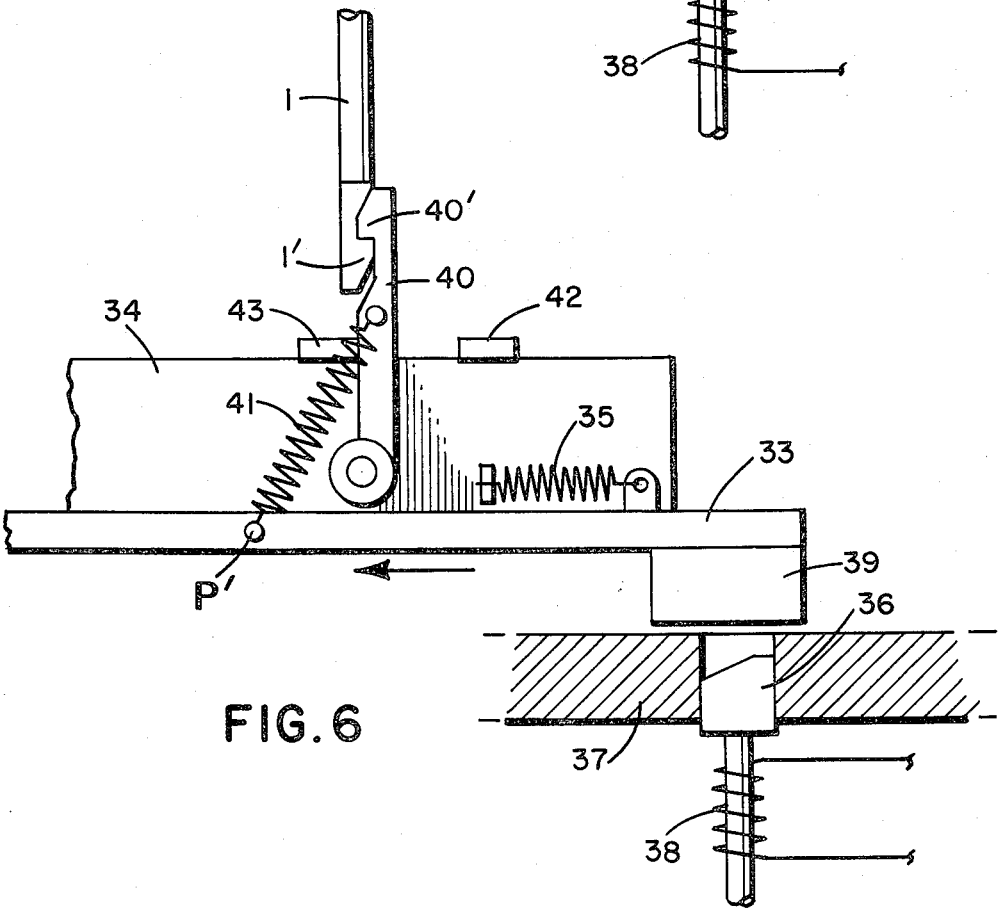

The blocking device for the healds, according to this invention (see FIGS. 3 to 6), consists of a revolving ring 33 arranged coaxially with the basis of cylindrical cam 16, above which there is arranged, still coaxially with it, a second fixed ring 34, integral with the basis of the loom. The fixed ring 34 has a diameter smaller than that of ring 33 and is provided with a cylindrical groove in which the lower ring 33 is mounted for rotation. The lower ring 33 and the upper ring 34 are connected to each other by one or more preloaded springs 35 which tend to rotate the mobile ring 33 according to arrow B (FIG. 6). The springs 35 have one end of each fixed to the periphery of the ring 33 and the opposed end fixed to the external surface of the fixed ring 34. The rotation of mobile ring 33 is, however, hindered during the working of the loom by peg 36, mounted vertically movable in a fixed guide 37, and subjected to the action of a driving solenoid 38. In the position shown in FIG. 6, ring 33 is held fast by peg 36 engaged against an appendix or lug 39 projecting from ring 33.

On the fixed ring 34 are hinged, in a parallel axis with respect to the single healds 1 and 2, rod-like hooks 40 which are kept out of line with respect to the axis of the single healds by a counteracting spring 41 anchored with one end to mobile ring 33. In the disengagement position (see FIG. 5), each rod-like hook 40 is kept resting against a ledge 42 fixed to the fixed ring 34, while the hinge point P is displaced, for instance, to the right in FIG. 5.

A rotation of the ring 33 moves the point P into position P' (FIG. 6) with hook 40 stopping against ledge 43 in a position of readiness for engaging its upper hook 40' with the analogous hook 1' at the lower end of the corresponding heald 1, once this attains its lower stop position.

Obviously, for each heald or each hook 40 there are provided one ledge 42 and one ledge 43, all fixed to the external surface of the fixed ring 34.

The blocking or locking of the healds in the lower position occurs automatically, both in the case of the breaking of a weft strip as well as on a command by the operator through control devices connected with the bobbins and the corresponding weft strip, or by a push-button.

The operation of the heald-blocking device occurs in the following way:

Saddles 28 and 29 (FIGS. 3 and 4) are made to rise up and to slide down by means of the corresponding guiding pads 26-27 constrained by and moving in the tracks 24 and 25 of the cylindrical cam 16, and during the weaving the hooks 40 are kept diverted from the axis of the healds (FIG. 5), that is, they are maintained on a different plane from that of the motion of the healds themselves.

In case of the rupture of a weft strip, or following the command of the operator of the loom, the solenoid 38 is automatically energized, whereupon the stopping peg 36, which keeps ring 33 blocked in contrast with the pull of springs 35, is activated and withdrawn from the engagement position with appendix 39, thereby allowing ring 33 to freely rotate. The preloaded spring 35 makes ring 33 rotate in the sense indicated by arrow B (FIG. 6), whereupon the hinge point of spring 41 passes from position P of FIG. 5 to position P' of FIG. 6. The hinge moment exerted on hook 40 by spring 41 reverses and thus the hook 40 moves against ledge 43 against which it is kept fast, that is, in a vertical position and on the coaxial alignment with the axis of the corresponding heald. As soon as heald 1, in its descending travel, meets hook 40', it will remain hooked to it by means of its end hook 1' (FIG. 6).

The hooking sequence of healds 1 and 2 is clearly illustrated by FIGS. 3 and 4. When the inner heald 2 is hooked in the lower position, as indicated previously, in order to achieve the hooking also of the outer heald 1, the central cam 16 must accomplish a further partial turn or rotation about its axis, in consequence of which, while the outer heald 1 is lowered and hooked to its own oscillating hook 40'' (FIG. 4), saddle 29 of the inner heald 2 by starting its rising travel compresses spring 32 against the tie clamp 30 thereby allowing its end-hook 2' (FIG. 3) to remain engaged to the oscillating hook 44 hinged to fixed ring 34.

In FIG. 4 the two healds are both locked in the lower position and in this position the tie clamp 31 of heald 2 remains detached from the corresponding saddle 28.

After the knotting again of the ruptured weft strip (or after replacement of the bobbin) an electromagnetic device 50 (FIG. 2)—actuated manually by a push-bottom not shown—rigidly connected with ring 33, causes mobile ring 33 to turn in the reversed direction, reestablishing in this way the preloading of springs 35 by the effect of the hooking of peg 36 against the appendix or lug 39 of the mobile ring 33.

Still further according to the invention, in order to eliminate or at least reduce to a minimum the formation of weft voids in the fabric in the event of breakage of the weft strip, there is provided an electromechanical device, shown in FIG. 2, whose task is that of effecting a differential stop of motion of the loom and a delayed resumption of the winding-up of the fabric, so as to obviate the cited drawbacks. That device consists of a pulley 45 coaxial with drive shaft 19, and a pulley 46 mounted on a shaft 47 of a drawing device of a conventional type not shown in the drawings, connected with each other through transmission belt 48. Between the pulley 46 and the shaft 47 of the conventional drawing gear there is arranged a conventional electromagnetic clutch 49. In order to effect a differential stop of the motion of the loom and a delayed resumption of the winding-up of the fabric, there is provided an electric control-circuitry (FIGS. 8-9) which comprises two sensing devices $F_1$ one placed in contact with the weft strips and the other with the warp strips, both connected with the coil of clutch 49 with the interposition of a timer T; this circuitry also comprises a second timer $T_1$ in series with the coil of clutch 21.

In case of breakage of a weft strip signalled by a sensing device $F_1$ in contact with the weft strip, clutch 49 is immediately disconnected, wherefore the drawing of the fabric is immediately stopped. Successively, also the main electromagnetic clutch 21 is disconnected and the whole loom is stopped. In the meantime, the shuttles will have accomplished a few turns wherefore, if no strip had broken, the weft would have thickened; the rupture of the strip leaves, however, behind it a certain void in the weft. After the reknotting of the broken weft strip, the loom is started again, first by actuating the main electromagnetic clutch 21, wherefore it starts weaving again regularly. Once the operational speed has been attained (after a preestablished interval of time, varying according to the type of weft chosen) electromagnetic clutch 49 is automatically actuated so that the weaving cycle will continue regularly. By this sequence (delayed stop of the loom in advance of the start of dragging of the fabric) there is obtained a thickening of the weft which, travelling vertically between the warp strips, will fill the voids previously left behind.

In any particular embodiment of the improved circular loom according to this invention, there obviously may be introduced modifications and variations structurally and functionally equivalent to those exemplified, without thereby falling outside the scope of the invention. Likewise, the dimensions of the loom, the type and dimensions of the strips to be woven, the number of shuttles, and other details, may vary according to practical requirements while still remaining within the scope of the invention as hereinabove described.

What is claimed is:

1. A circular loom for tubular fabric consisting essentially of strips of synthetic, artificial and natural substances, and especially strips of synthetic polymers, said loom being of the vertical heald type with healds arranged on concentric rings, with the drawing and the winding up of the fabric being formed on a fabric gauging cylinder arranged downstream of the shuttles, characterized in that said loom comprises one single rotary positive cam with a double track for the control of the alternate motion of the healds, said cam consisting essentially of a hollow cylinder turing coaxially inside the fabric-gauging cylinder and on whose outside cylindrical surface there are provided two closed track guide cams having a substantially helicoidal development, of which one is the cam controlling the motion of the external healds, while the other controls the internal healds, those guiding cams being associated with guide-pads which are integral with saddles carrying the healds mounted slidably in fixed vertical guides, thereby imparting to the two series of healds their alternate up-and-down motion, said healds being, moreover, axially constrained by elastic or resilient means to the corresponding supporting saddles so that they may be all blocked automatically in their lower position by the hooking in of their lower ends on corresponding oscillating hooks mounted displaceably in a coaxial alignment with the healds themselves, so as to retain all the warp strips on a level below the plane of sliding of the shuttles.

2. A circular loom according to claim 1, characterized in that each vertical heald is mounted on the corresponding saddle by interposition of a preloaded spring, inserted between two tie clamps, blocked on the heald, and of which one, the lower one, is arranged below and in contact with the saddle itself, so as to constrain the heald stem in a vertical sense to the corresponding saddle, thereby enabling the heald itself to slide within the saddle itself by the further compression of said spring, actuated by the displacement of the saddle when the heald is blocked in the lower position.

3. A circular loom, according to claim 1, characterized in that for the blocking of the healds in the lower position, a series of hooks hinged on a fixed ring is provided, each of which is in correspondence with the axis of a heald, and all of which are maintained diverged with respect to the healds by means of a pulling spring, all the pulling springs of the hooks being hinged on a turntable linked to said fixed ring by means of at least one pulling spring, so as to displace the fulcra of said springs to such an extent as to cause the hooks to dispose themselves in line with the axis of the corresponding healds, and thus allow the hooking and stopping of the latter in the lower position during their downward travel, the control of said turntable, intended for moving the hooks in axis with the healds, being imparted automatically either in the event of breaking of the weft strip as well as when the replacement of the bobbins is required.

4. A circular loom according to claim 3, characterized in that said turntable, intended to bring the hooks in line with the axis of the corresponding healds, consists substantially of a revolving ring coaxial with said fixed ring, and coupled to this latter by preloading springs, said rotating ring being blocked, so as to ensure the aforesaid preload of said springs, by means of a movable stopping device activated by a signal emitted either by the shuttles or upon a manual command of the operator of the loom, in case of the rupture of a weft strip or when the replacement of the bobbins is required.

5. A circular loom according to any one of the preceding claims, characterized in that, in order to avoid the formation in the fabric of weft voids in case of the breaking of a weft strip, a stopping device is provided for the differential stopping of the loom and for the delayed winding up of the fabric, consisting of an electromagnetic clutch, linked to the main drive motor of the loom, and controlling the fabric-drawing assembly, said clutch being arranged to stop, on an electric signal sent by the shuttles, the fabric-drawing device in case of rupture of the weft strip, and to restart the drawing device itself after a predetermined delay with respect to the starting of the loom, thereby obtaining a thickening of the weft that will fill up the void left previously by the rupture of the weft strip.

* * * * *